US010190755B2

(12) United States Patent
Collins

(10) Patent No.: US 10,190,755 B2
(45) Date of Patent: Jan. 29, 2019

(54) LED BOARD RETENTION

(71) Applicant: ABL IP Holding LLC, Decatur, GA (US)

(72) Inventor: Patrick A. Collins, Conyers, GA (US)

(73) Assignee: ABL IP Holding LLC, Atlanta, GA (US)

( * ) Notice: Subject to any disclaimer, the term of this patent is extended or adjusted under 35 U.S.C. 154(b) by 80 days.

(21) Appl. No.: 15/351,699

(22) Filed: Nov. 15, 2016

(65) Prior Publication Data

US 2018/0135838 A1 May 17, 2018

(51) Int. Cl.

| | |
|---|---|
| ***F21V 21/00*** | (2006.01) |
| ***F21V 21/088*** | (2006.01) |
| ***F21V 19/00*** | (2006.01) |
| *F21Y 115/10* | (2016.01) |

(52) U.S. Cl.
CPC ..... *F21V 21/088* (2013.01); *F21V 19/003* (2013.01); *F21Y 2115/10* (2016.08)

(58) Field of Classification Search
USPC ..... 362/249.02
See application file for complete search history.

(56) References Cited

U.S. PATENT DOCUMENTS

| | | | |
|---|---|---|---|
| 5,403,102 | A | 4/1995 | Yokoyama |
| 5,440,470 | A | 8/1995 | Ly |
| 6,737,791 | B2 | 5/2004 | McCullough et al. |
| 6,998,650 | B1 | 2/2006 | Wu |
| 7,207,710 | B2 | 4/2007 | Kim |
| 7,510,317 | B2 | 3/2009 | Murakami et al. |
| 8,192,059 | B2 | 6/2012 | Yokota et al. |
| 8,226,280 | B2 | 7/2012 | Daily et al. |
| 8,430,520 | B2 | 4/2013 | Takeba |
| 8,430,554 | B2 | 4/2013 | Hasegawa |
| 8,454,183 | B2 | 6/2013 | Hisada |
| 8,475,000 | B2 | 7/2013 | Tamai |
| 8,485,685 | B2 | 7/2013 | He et al. |
| 8,536,768 | B2 * | 9/2013 | Van Gennip ..... F21K 9/00 313/11 |
| 8,764,220 | B2 | 7/2014 | Chan et al. |
| 2011/0069493 | A1 | 3/2011 | Huang |
| 2012/0020086 | A1 | 1/2012 | Kataoka |
| 2013/0294061 | A1 | 11/2013 | Sorensen et al. |
| 2015/0124449 | A1 | 5/2015 | Wilcox et al. |
| 2015/0241035 | A1 | 8/2015 | Dankelmann et al. |

* cited by examiner

*Primary Examiner* — Vip Patel
(74) *Attorney, Agent, or Firm* — Kilpatrick Townsend & Stockton LLP

(57) ABSTRACT

Retention members for securing LED boards to substrates while permitting light from the LEDs to be emitted unobstructed. The present retention members may be in the form of clips that are designed to span an LED board and attach to a substrate so as to trap the LED board between a retention member and the substrate. The retention members described herein may include one or more retention features that may interface with a corresponding mounting feature formed on the substrate to secure the retention member and thus the LED board to a substrate.

17 Claims, 15 Drawing Sheets

LED BOARD RETENTION

BACKGROUND OF THE INVENTION

Conventional light emitting diode (LED) boards are attached and retained to substrates, such as heat sinks or housings, using mechanical fasteners or features inherent to the substrate. For example, screws or metallic clips are often used that catch an edge or corner of the LED board to hold it in place on an underlying substrate. However, the fastener heads and metallic clips oftentimes extend above the LEDs so as to block light and/or create shadows.

BRIEF SUMMARY OF THE INVENTION

The terms "invention," "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various aspects of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

Embodiments of the present invention provide retention members for securing LED boards to substrates while permitting light from the LEDs to be emitted unobstructed. The present retention members may be in the form of clips that are designed to span an LED board and attach to a substrate so as to trap the LED board between a retention member and the substrate. The retention members described herein may include one or more retention features that may interface with a corresponding mounting feature formed on the substrate to secure the retention member and thus an LED board to the substrate.

BRIEF DESCRIPTION OF THE DRAWINGS

A further understanding of the nature and advantages of various embodiments may be realized by reference to the following figures. In the appended figures, similar components or features may have the same reference label. Further, various components of the same type may be distinguished by following the reference label by a dash and a second label that distinguishes among the similar components. If only the first reference label is used in the specification, the description is applicable to any one of the similar components having the same first reference label irrespective of the second reference label.

DETAILED DESCRIPTION OF THE INVENTION

The subject matter of embodiments of the present invention is described here with specificity to meet statutory requirements, but this description is not necessarily intended to limit the scope of the claims. The claimed subject matter may be embodied in other ways, may include different elements or steps, and may be used in conjunction with other existing or future technologies. This description should not be interpreted as implying any particular order or arrangement among or between various steps or elements except when the order of individual steps or arrangement of elements is explicitly described.

Embodiments of the present invention provide retention members having low profiles. These retention members help secure LED boards to substrates while permitting light from the LEDs to be emitted unobstructed. The design of the retention members may be based on the needs of a particular application. For example, the retention member may be designed based on the layout of LEDs on an LED board. As just one example, if an LED board includes LEDs arranged in a single row or in symmetrical, parallel rows, a generally rectangular retention member may be inserted between adjacent LEDs. As another example, if an LED board includes LEDs arranged in staggered rows such that each LED in one row is aligned with a blank space formed between adjacent LEDs in a second row, a different retention member may be used. In some embodiments, LED boards with LEDs arranged in staggered rows may have the LEDs offset from one another, in a non-orderly arrangement and/or other arrangement.

The retention members described herein may include one or more retention features that may each interface with a corresponding mounting feature formed on a substrate to secure the retention member and an LED board to the substrate. For example, the retention features of the retention member may include a protrusion designed to be inserted and held within an aperture formed within the substrate. In some embodiments, the retention members described herein may be formed of electrically non-conductive materials, such as plastics, rubbers, composite materials, and/or combinations thereof. In some embodiments, the retention members, when installed, are no thicker than a height of the LEDs. This ensures that the retention members do not extend beyond the LEDs and obstruct the light emitted from the LED board.

Figure 1A:
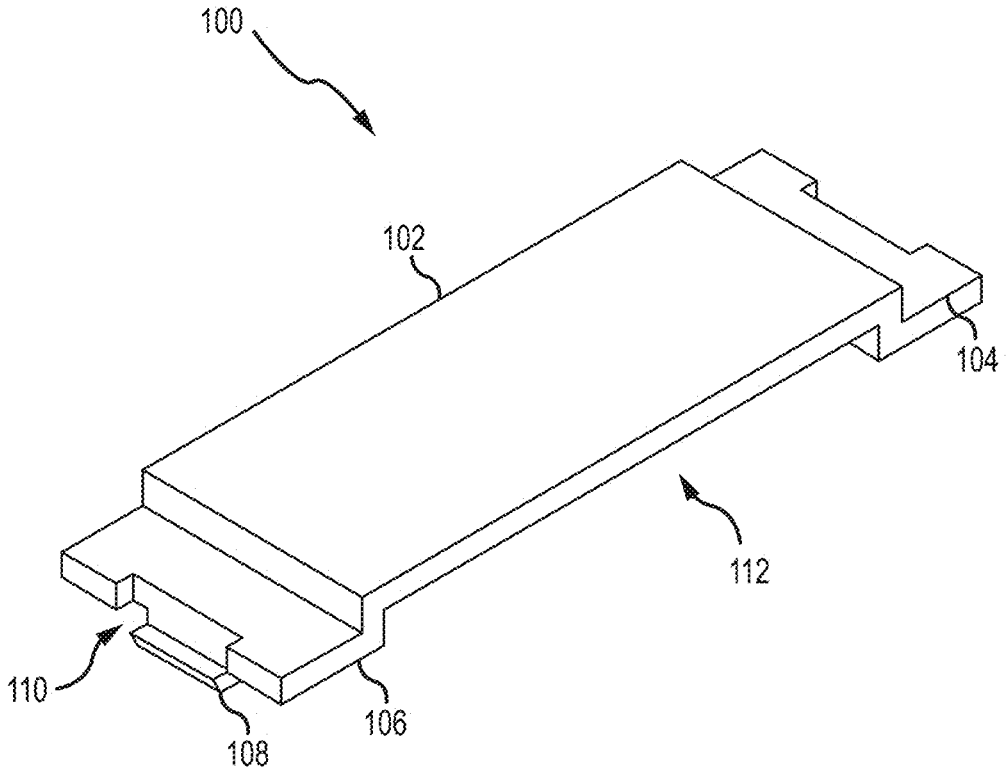
FIG. 1A depicts an isometric view of a retention member according to embodiments.

Turning to FIG. 1A, one embodiment of a retention member 100 is shown. Retention member 100 may include a retention member body 102 from which a first retention wing 104 and a second retention wing 106 extend. The retention member body 102 may be configured to span some or all of a width of an LED board that is to be secured to a substrate. At least a portion of the first retention wing 104 and the second retention wing 106 are configured to extend beyond the width of the LED board such that retention features on each of the wings 104, 106 may interface with the substrate to secure the LED board to the substrate.

Figure 1B:
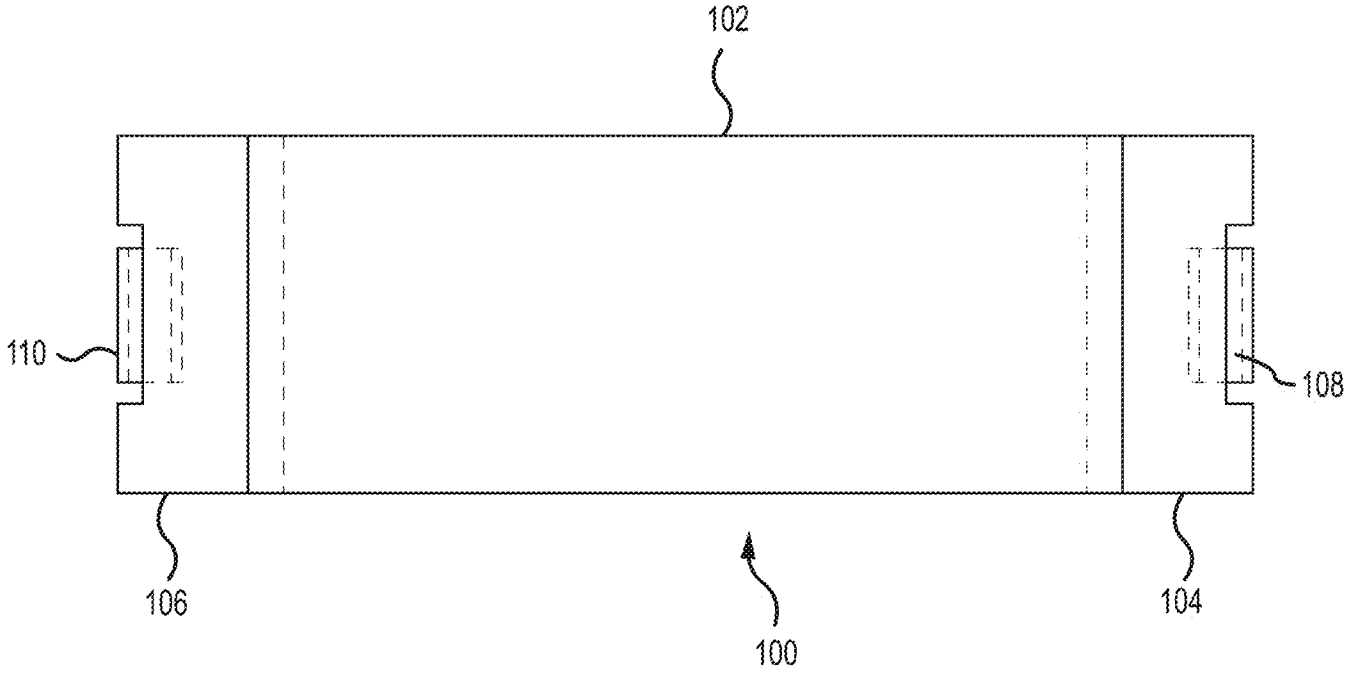
FIG. 1B depicts a top view of the retention member of FIG. 1A according to embodiments.
Figure 1C:
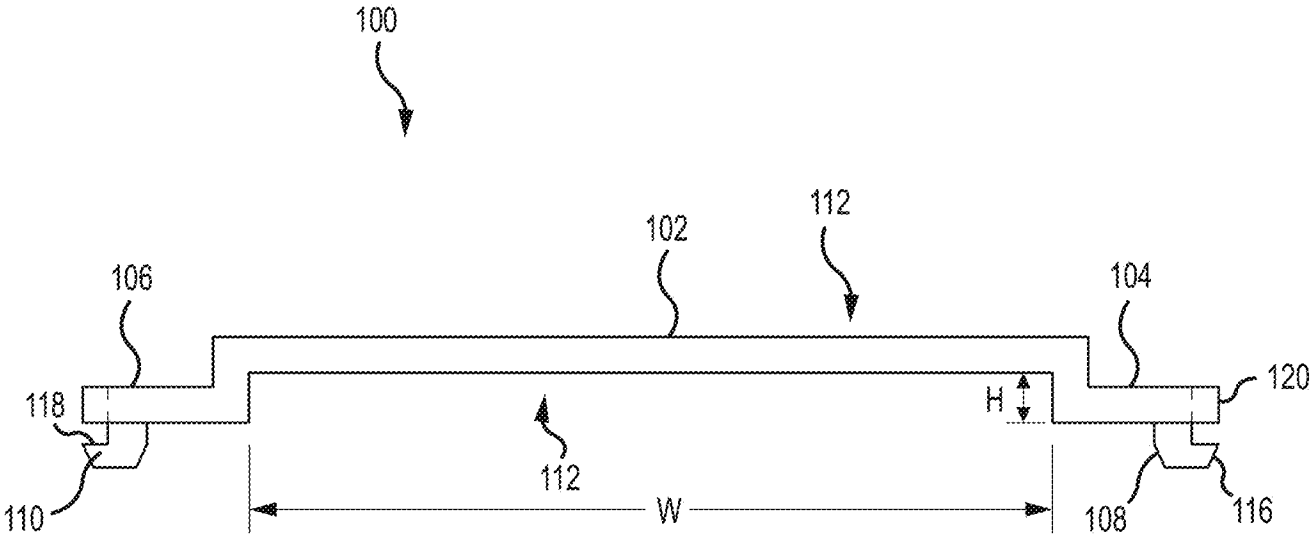
FIG. 1C depicts a side view of the retention member of FIG. 1A according to embodiments.

In some embodiments, the first retention wing 104 and the second retention wing 106 may extend from the retention member body 102 in a plane offset from the plane of the retention member body 102, such as in a stepped fashion as shown in FIG. 1C. In this way, a board receiving recess 112 is formed in the underside of the retention member 100. Oftentimes, the retention member body 102 may be in contact with the LED board and/or provide tension to the LED board. Such contact may be desirable to create a path for thermal conduction from the LED board to the substrate so as to facilitate heat dissipation from the light sources. In some embodiments, the height (H) and/or width (W) of the board receiving recess 112 is approximately equal to the thickness and width of the LED board. This allows the bottom surface of the retention member body 102 to be positioned flush, or substantially flush, against a surface of the LED board while a bottom retention surface of each of the first retention wing 104 and second retention wing 106 may be positioned flush, or substantially flush, against a surface of the substrate. In other embodiments, the height (H) and/or width (W) of the board receiving recess 112 may be greater than the thickness and/or width of the LED board. In some cases, the retention member body 102 may be formed in a non-linear manner, such that the retention member body 102 is bowed and/or U-shaped, with the retention member body 102 bowing toward the LED board between the first retention wing 104 and the second retention wing 106. In such embodiments, a medial portion of the retention member body 102 may contact a portion of the LED board. Multiple bowed portions may be provided between the first retention wing 104 and the second retention wing 106. The use of a non-linear retention member body 102 provides less contact on the LED board while still adequately supporting and maintaining the LED board in position against the substrate.

Each of the first retention wing 104 and the second retention wing 106 may include one or more retention features for engaging the substrate on which the LED board is to be secured. For example, the first retention wing 104 and the second retention wing 106 may include a retention feature in the form of a protrusion 108 extending from each wing 104, 106. As one example, protrusion 108 may extend from a bottom surface of the first retention wing 104 and the second retention wing 106 (see FIG. 1C). In use, retention member 100 is positioned over the LED board such that the LED board resides in the board retention recess 112. Protrusions 108 are inserted (such as via a snap-fit connection) within apertures or other mounting features defined in opposing sides of a substrate to secure the LED board on the substrate.

Protrusions 108 may include a flange 110 that helps facilitate installation of the retention member 100 as well as prevent inadvertent back-out. In some embodiments, the flange 110 includes a tapered surface 116 to facilitate insertion of the protrusion 108 within an aperture of the substrate. A top surface 118 of the flange 110 may be flat or substantially flat so as to prevent the protrusion 108 from backing out of the aperture. In other embodiments, a protrusion may extend from a distal edge 120 of the first retention wing 104 and/or the second retention wing 106 and be configured to slide into a slit formed in the substrate to secure the retention member 100.

In some embodiments, the retention member 100 may be formed from materials that render the retention member 100 or portions thereof flexible and/or able to elastically deform. By way of example, the retention member body 102 may be flexible such that a protrusion on first end of the retention member 100 can to be inserted within a slit in the substrate and the retention member body 102 may be flexed so as to permit a protrusion on the second end to be inserted within a second slit in the substrate. The retention member may then be allowed to straighten, thereby securing the retention member to the substrate. Similarly, the protrusion 108 may also be able to flex and elastically deform so as to permit insertion within, but to resist removal from, mounting features on the substrate.

It will be appreciated that other retention features may be included on the first retention wing 104 and/or the second retention wing 106 of retention member 100. For example, other retention features that may be interfaced with a mounting feature of a substrate include snap joints that include a protruding part of one component, such as a hook, stud, or bead, which may be deflected when inserted into an opening. The deflected component may then be caught within a depression in the retention component, such as an underside of a substrate defining an aperture. Such snap joints may include cantilever snap joints, u-shaped snap joints, torsion snap joints, annular snap joints, and the like. For example, each of the plurality of mounting features of the substrate may include a receptacle defined by the substrate. Each receptacle may define an opening. The flange 110 and/or protrusion 108 of the first retention wing 104 may be insertable within the opening of the receptacle such that the flange 110 extends beyond an outer periphery of the opening and is prevented from being removed by an underside of the substrate. Although described here with the first retention wing 104 and the second retention wing 106 including male retention features that are insertable within female mounting features of a substrate, it will be appreciated that each of the first retention wing 104 and second retention wing 106 may define female retention features that are configured to receive male mounting features of a substrate. It will be appreciated that in some embodiments the first retention wing 104 and second retention wing 106 may define receptacles that are configured to engage with protrusions or other mounting features of the substrate. Additionally, it will be appreciated that the first retention wing 104 and second retention wing 106 may include one or more retention features, and at least some of the retention features on each end may be the same or different from one another.

In some embodiments, retention member body 102 may be formed to have a thickness that is no greater than the height of the LEDs on an LED board. This ensures that, when the retention member 100 is used to secure the LED board to a substrate, that the retention member body 102 does not extend above the LEDs so as to obstruct the light emitted from the LEDs. This allows a maximum amount of usable light to be emitted from an LED board and prevents any shadows to be produced that may diminish the aesthetics of a lighting fixture. Additionally, the retention member 100 may be formed from an electrically non-conductive material, such as plastics, rubbers, polymers, and/or combinations thereof. The retention members 100 described herein may be molded, 3D printed, machined, and/or otherwise formed.

FIG. 1B shows a top view of retention member 100. As shown here, retention member 100 has a generally rectangular profile, however other shapes may be contemplated. For example, non-solid and/or contoured shapes, such as an hourglass shape having a retention member body 102 with wide ends and a narrow medial section, may be used to reduce the amount of material required for production of the retention member 100. The size and shape of the retention member 100 may be determined based on the size and arrangement of an LED board that the retention member 100 is to secure. Retention member 100 is particularly well-suited for use with an LED board having LEDs arranged in a single row or in symmetrical, parallel rows such that the retention member 100 can be positioned in the space between adjacent LEDs.

Figure 2A:
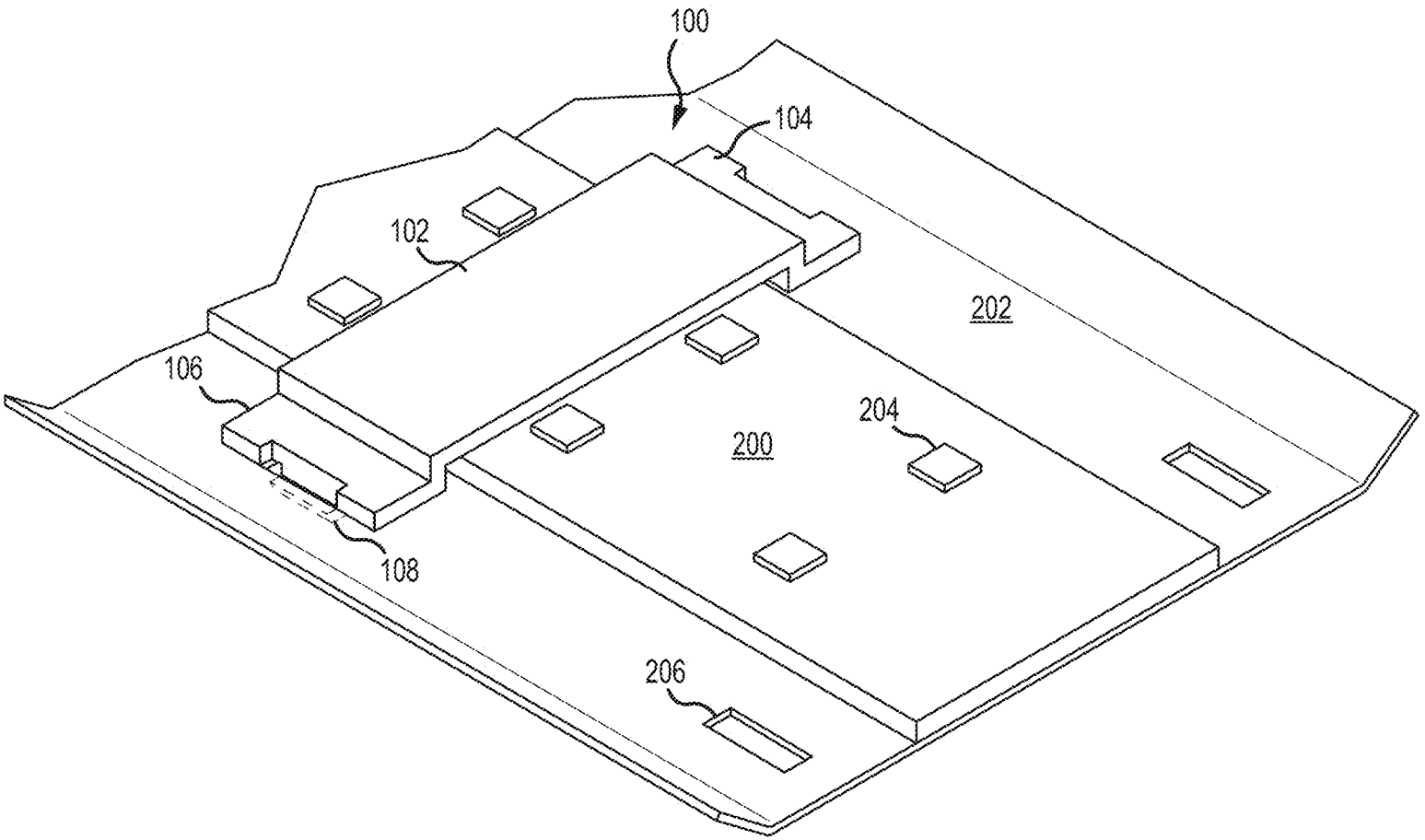
FIG. 2A depicts an isometric view of the retention member of FIG. 1A securing an LED board to a substrate according to embodiments.

FIG. 2A shows the retention member 100 positioned over an LED board 200 and secured to a substrate 202. LED board 200 includes one or more rows of LEDs 204. In the illustrated embodiment, the LEDs 204 are positioned in symmetrically aligned rows such that an LED 204 in each row is positioned laterally adjacent an LED 204 within the adjacent row. It will be appreciated that any number of rows may be present on LED board 200. Substrate 202 includes at least two mounting features 206 in alignment with one another on opposite sides of the LED board 200. Here, mounting features 206 are in the form of apertures or slits formed within the substrate 202, but other mounting features 206 may be contemplated. Retention member 100 is positioned within a blank space formed between adjacent LEDs 204. More specifically, retention member body 102 seats over LED board 200 such that the LED board 200 resides within board receiving recess 114. When so positioned, first and second retention wings 104, 106 extend outwardly from the LED board 200 and protrusions 108 engage mounting features 206 in substrate 202.

Figure 2B:
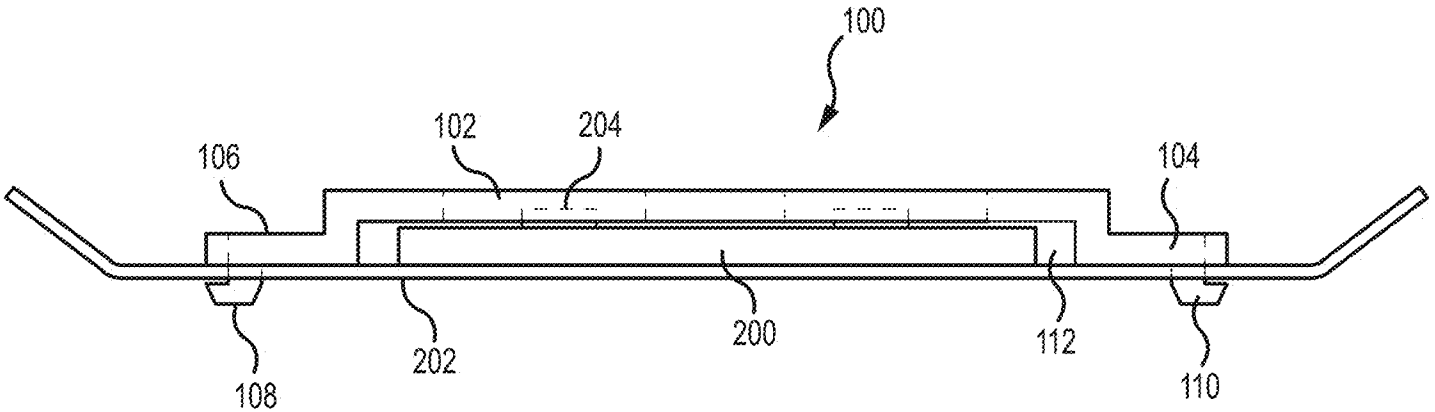
FIG. 2B depicts a cross-sectional view of the retention member of FIG. 1A securing an LED board to a substrate according to embodiments.

As shown in FIG. 2B, in some embodiments retention member 100 may be positioned flush against the LED board 200 and/or the substrate 202. For example, an underside of the retention member body 102 may be positioned flush against the LED board 200 so as to trap the LED board 200 against the substrate 202 and prevent inadvertent movement of the LED board 200. Similarly, lower surfaces of the first retention wing 104 and the second retention wing 106 may be positioned flush against the substrate 202 such that they are unable to deflect downwardly toward the substrate 202, which could result in the protrusions 108 disengaging from the substrate 202. However, flush positioning of portions of the retention member 100 relative to the LED board 200 and/or substrate 202 is not required in all applications. Additionally, while shown here with board receiving recess 112 being wider than the LED board 200, it will be appreciated that in some embodiments the widths will be substantially the same.

As seen in FIG. 2B, a portion of each protrusion 108 and flange 110 extends through the apertures or slits that form mounting features 206, with a portion of each flange 110 extending beyond an outer periphery of the apertures so as to contact an underside of the substrate 202, thereby preventing the protrusion 108 form disengaging from the mounting feature 206. To remove the retention member 100 from the substrate 202, a thin flat object may be inserted between each of the wings 104, 106 and the substrate 202 to flex each protrusion 108 inward so as to align the flange 110 with the mounting feature 206, thereby allowing the protrusion 108 to be pulled back through the mounting feature 206 so as to remove the retention member 100.

Figure 3A:
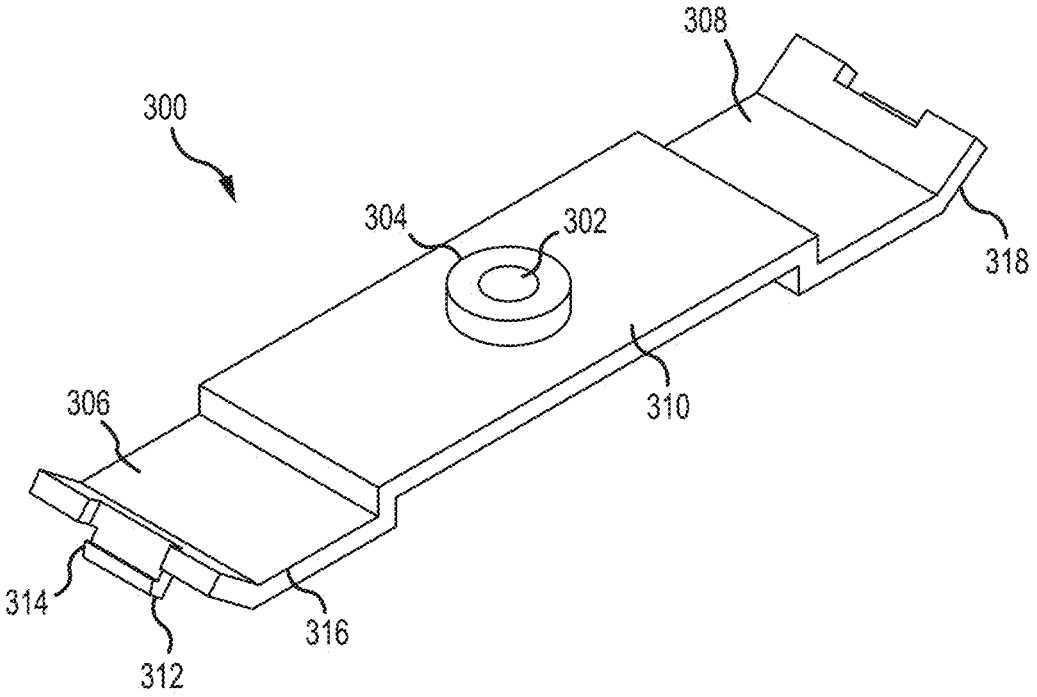
FIG. 3A depicts an isometric view of a retention member with a through hole for a fastener according to embodiments.
Figure 3B:
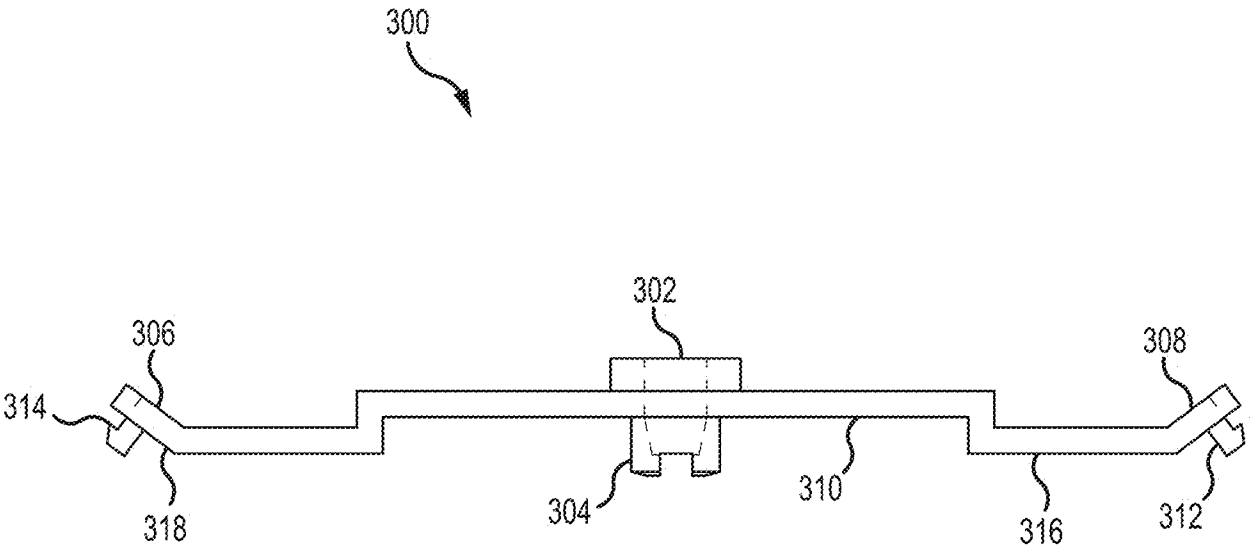
FIG. 3B depicts a side view of the retention member of FIG. 3A according to embodiments.

In some embodiments, retention members may be additionally secured using a fastener, such as a screw. For example, in FIG. 3A, retention member 300 defines a central aperture 302 that is configured to receive a screw or other fastener. In some embodiments, retention member 300 may also include a collar 304 formed around aperture 302 as shown in FIG. 3B. Collar 304 may provide extra strength and support for the retention member 300, reducing the likelihood that overtightening the fastener will result in cracking or otherwise damaging the retention member 300. Retention member 300 may have a similar structure as retention member 100 described above. For example, retention member 300 may include a retention member body 310 from which extend first and second retention wings 306, 308. The first and second retention wings 306, 308 may each include a protrusion 312 and/or flange 314 that are used as retention features that interface with corresponding mounting features on a substrate to secure the retention member 300 to the substrate. In this embodiment, a first portion 316 of each of the first and second retention wings 306, 308 is planar while a second portion 318 is angled relative to first portion 316. Such a design enables the retention member 300 to be coupled with a non-planar substrate.

Figure 4A:
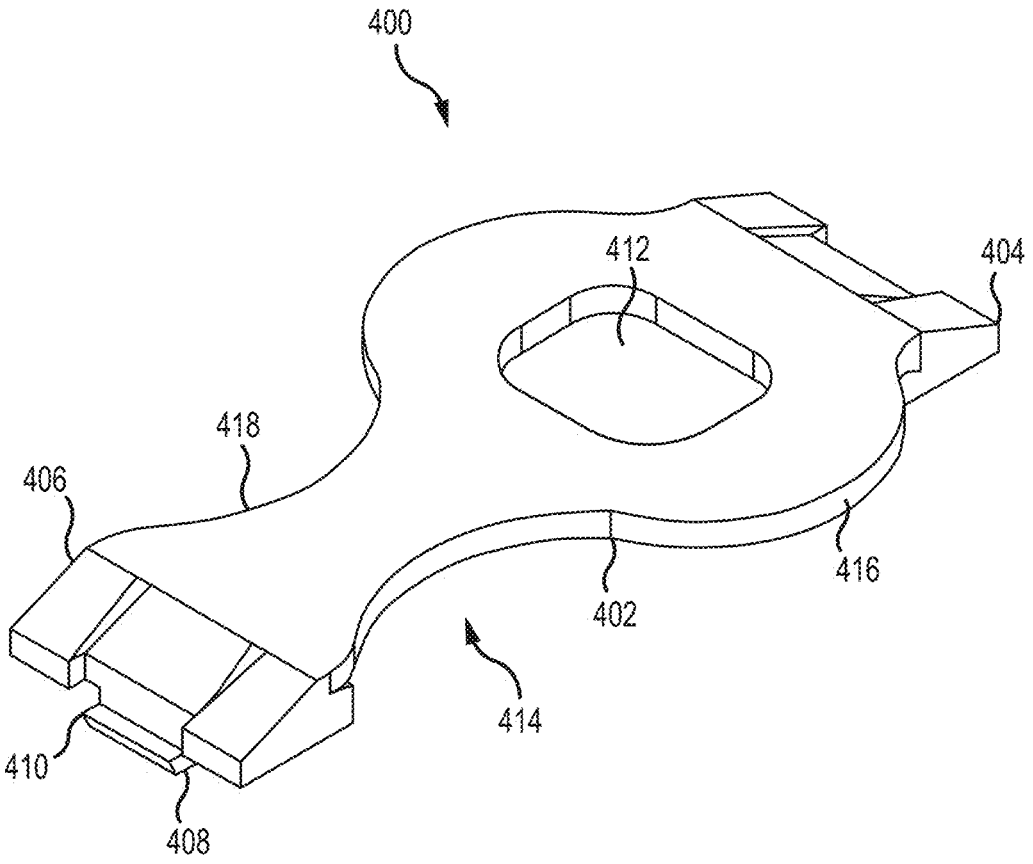
FIG. 4A depicts an isometric view of a retention member according to embodiments.
Figure 4B:
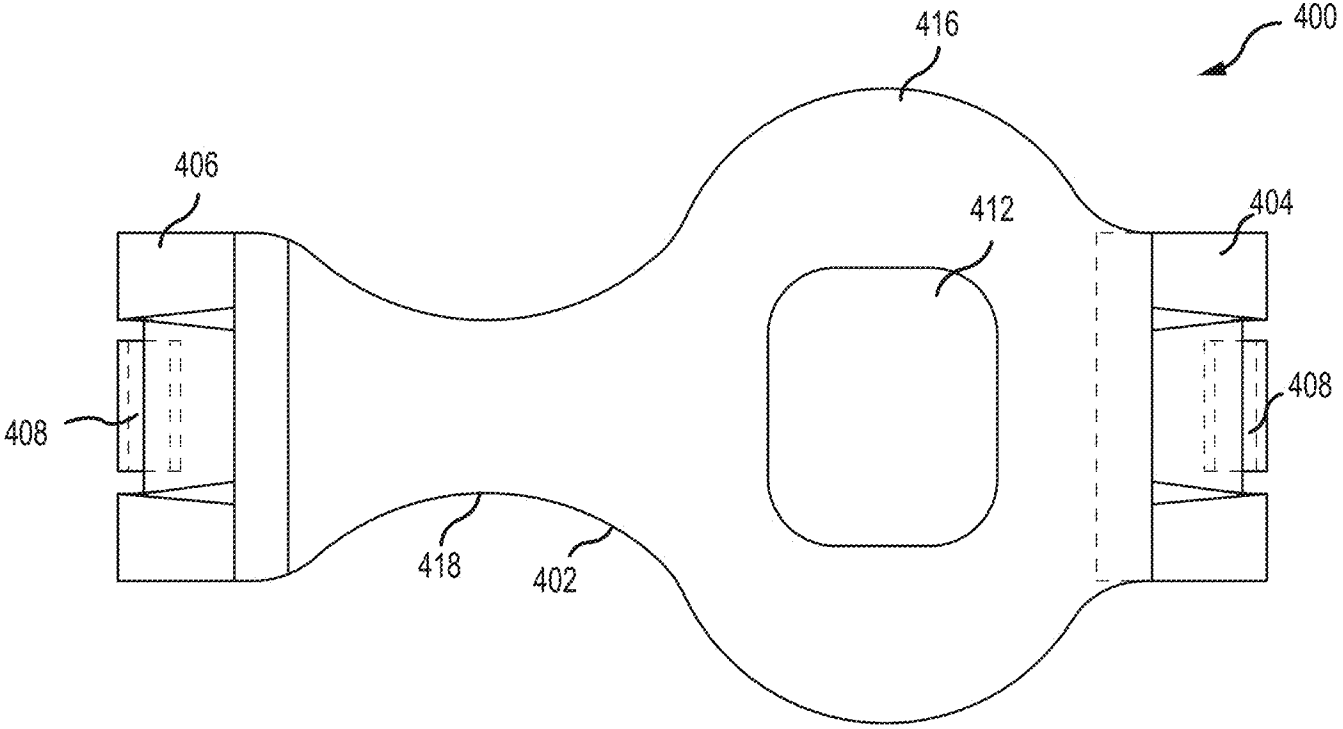
FIG. 4B depicts a top view of the retention member of FIG. 4A according to embodiments.

FIG. 4A depicts another embodiment of a retention member 400. Retention member 400 may include similar features as retention member 100. For example, retention member 400 may include a retention member body 402, first and second retention wings 404, 406, and a board receiving recess 414. The retention member body 402 may be configured to span at least a portion of a width of an LED board that is to be secured to a substrate. The first and second retention wings 404, 406 are configured to extend beyond the width of the LED board such that the wings 404, 406 may interface with the substrate to secure the retention member 400 and LED board to the substrate. Retention member body 402 may include a first portion 416 in which an aperture 412 is defined and a second portion 418 devoid of an aperture. Aperture 412 may be configured to align with one or more LEDs of the LED board. This retention member 400 geometry is particularly well-suited for use with an LED board having LEDs arranged in staggered and/or offset rows such that an LED of one row is positioned laterally adjacent a blank space formed between adjacent LEDs in an adjacent row. For example, the retention member 400 can be positioned over the LED board such that one or more LEDs are located within the aperture 412 and the second portion 418 of retention member body 402 extends within the blank space opposite the LED. In this way, light from the LED(s) seated within aperture 412 can pass unobstructed through the retention member 400.

Both the first and second retention wings 404, 406 may include one or more retention features, similar to those described above in relation to retention member 100. For example, the first and second retention wings 404, 406 may include a retention feature in the form of a protrusion 408. Protrusion 408 may extend away from a surface of the first and second retention wings 404, 406. As one example, a protrusion 408 may extend from a bottom surface of the first and second retention wings 404, 406. In some embodiments, protrusion 408 may include a flange 410 or other feature that may be inserted within an aperture or other mounting feature defined in a substrate. It will be appreciated that other retention features may be included on the first retention wing 404 and/or the second retention wing 406 of retention member 400.

Figure 4C:
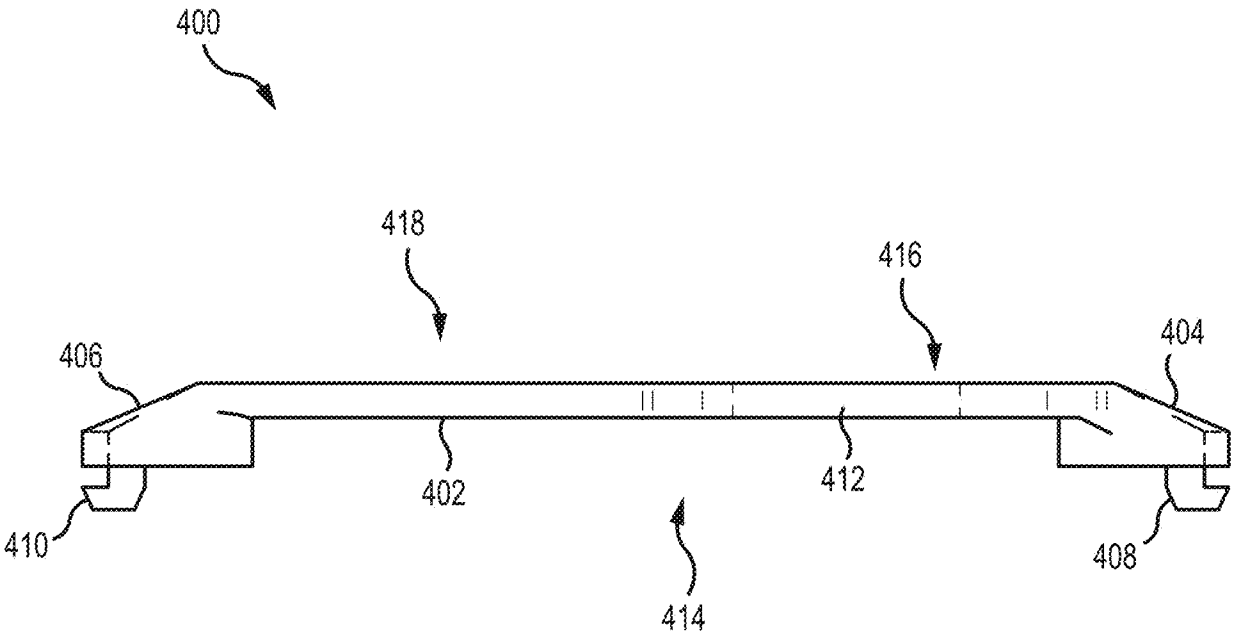
FIG. 4C depicts a side view of the retention member of FIG. 4A according to embodiments.

FIG. 4C shows a top view of retention member 400. As shown here, retention member 400 has a key-shaped profile, with the first portion 416 of the retention member body 402 defining aperture 412 being wider than the second portion 418 of the retention member body 402. As described above, however, the retention member body 402 may be of any shape.

Figure 5A:
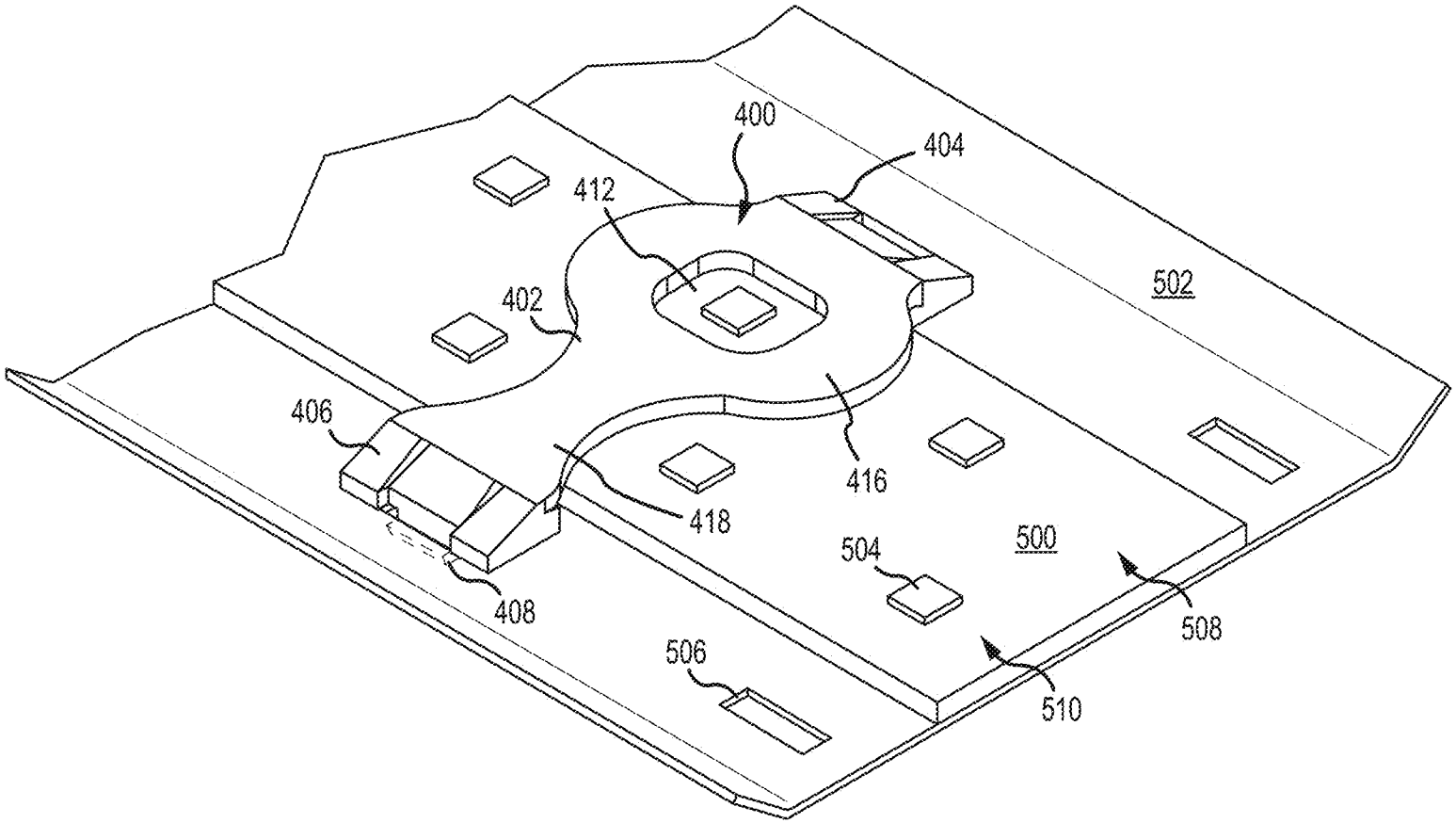
FIG. 5A depicts an isometric view of the retention member of FIG. 4A securing an LED board to a substrate according to embodiments.
Figure 5B:
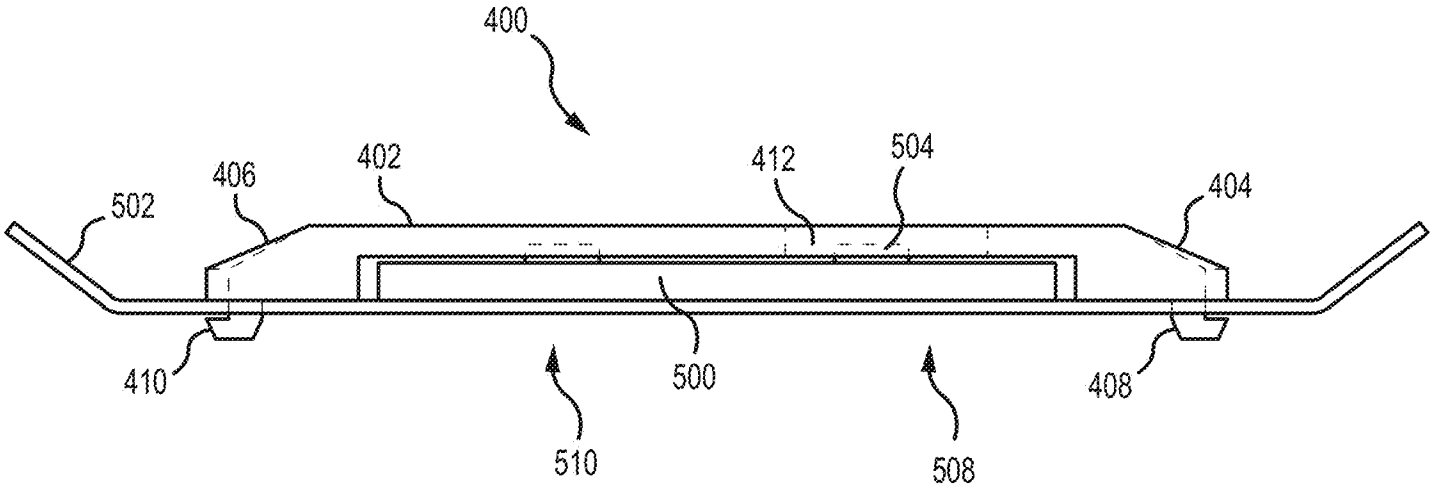
FIG. 5B depicts a cross-sectional view of the retention member of FIG. 4A securing an LED board to a substrate according to embodiments.

FIGS. 5A and 5B depict the retention member 400 positioned over an LED board 500 and secured to a substrate 502. LED board 500 includes one or more rows of LEDs 504. In the illustrated embodiments, the LEDs 504 are positioned in staggered and/or offset rows such that an LED 504 of a first row 508 is positioned laterally adjacent a blank space formed between adjacent LEDs 504 in an adjacent second row 510. Substrate 502 includes at least two mounting features 506 in alignment with one another on opposite sides of the LED board 500. Here, mounting features 506 are in the form of apertures or slits formed within the substrate 502. As shown in FIG. 5B, retention member 400 is positioned over LED board 500 so as to be flush against the LED board 500 and/or the substrate 502. However, flush positioning of portions of the retention member 400 relative to the LED board 500 and/or substrate 502 is not required in all applications. The aperture 412 formed in the first portion 416 of the retention member body 402 is positioned around one of the LEDs 504 in the first row 508 of LEDs 504 of the LED board 500, while the second portion 418 of the retention member body 402 extends within a blank space formed between adjacent LEDs 504 of the second row 510 of LEDs 504. The protrusions 408 on first and second retention wings 404, 406 are engaged with mounting features 506 of the substrate 502. As seen in FIG. 5B, a portion of each protrusion 408 extends through the apertures or slits that form mounting features 506, with a portion of each flange 410 extending beyond an outer periphery of the apertures so as to contact an underside of the substrate 502, thereby preventing the protrusions 408 from disengaging from the mounting features 506.

Figure 6:
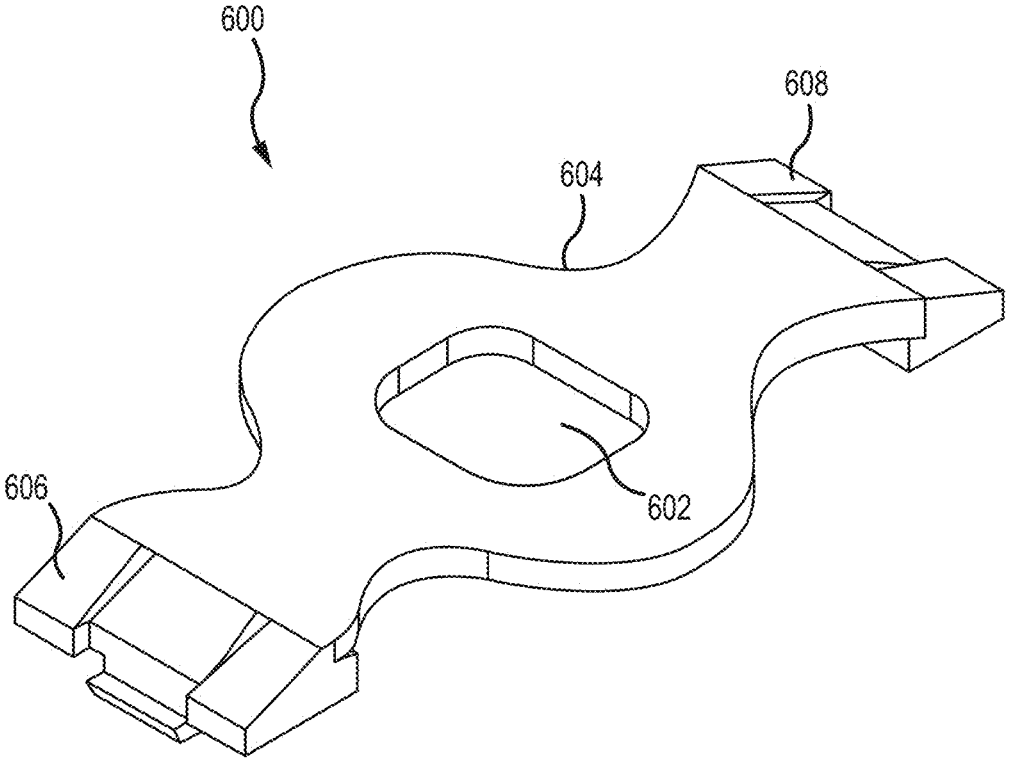
FIG. 6 depicts an isometric view of a retention member according to embodiments.
Figure 7:
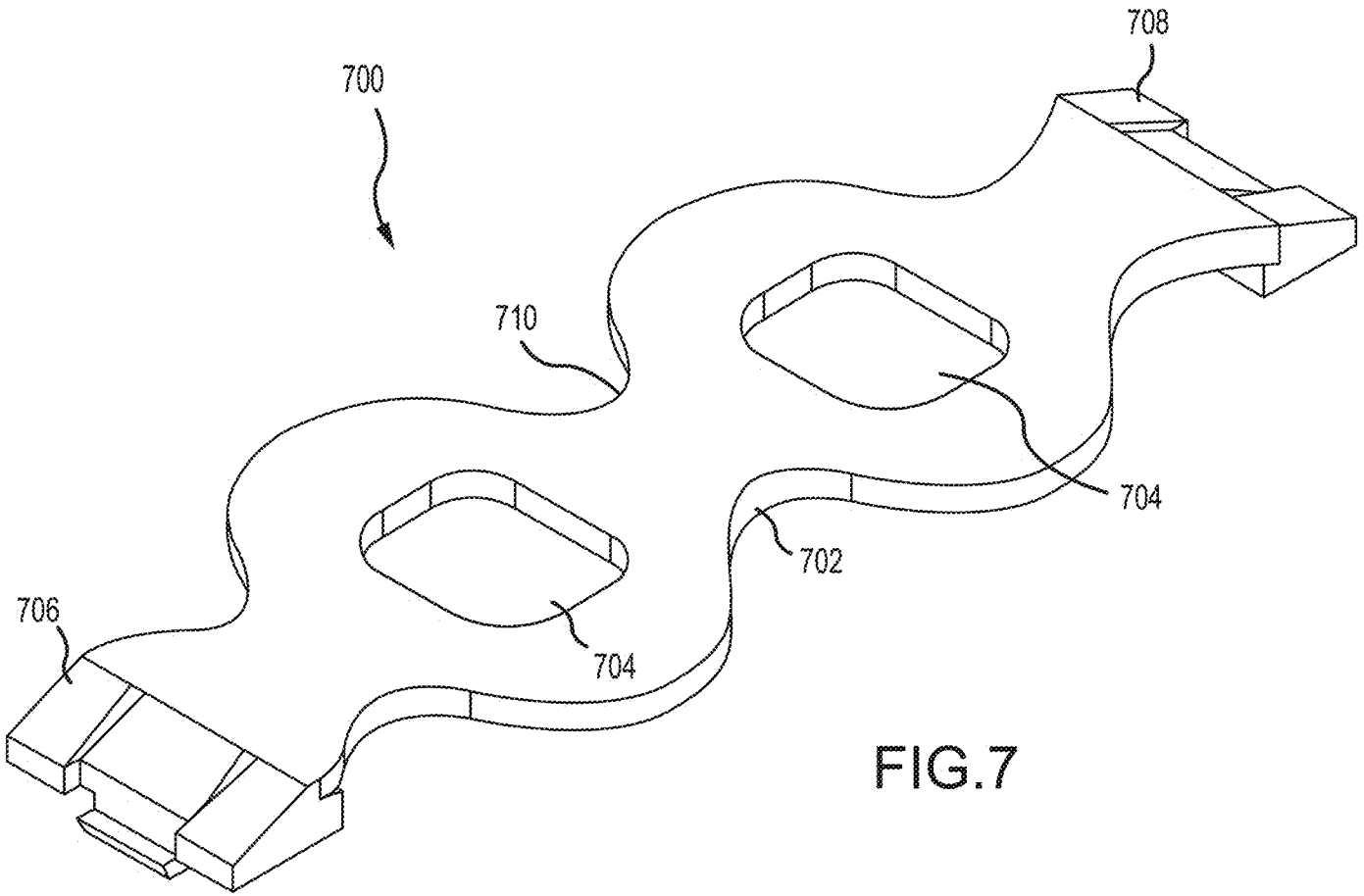
FIG. 7 depicts an isometric view of a retention member according to embodiments.

It will be appreciated that other designs of retention members may be contemplated based on the design of an LED board to be retained. For example, as shown in FIG. 6, for an LED board having three or more rows of staggered LEDs, a retention member 600 may define a central aperture 602 configured to receive an LED in the center row, while the retention member body 604 near the first and second retention wings 606 and 608 may be positioned within blank spaces formed between adjacent LEDs of the two outer rows. In other embodiments, as shown in FIG. 7, a retention member 700 may have a retention member body 702 that defines an aperture 704 proximate each of the first and second retention wings 706, 708. Such a retention member 700 may be used for LED boards with two rows of symmetrically aligned LEDs, with each aperture 704 being positioned around an LED in one of the two rows. Retention member 700 may also be used in LED boards with staggered and/or offset LED rows, with the apertures 704 proximate the first and second retention wings 706, 708 being positioned around LEDs on the outer rows while a medial portion 710 of the retention member body 702 extends within a blank space formed between adjacent LEDs of a center row of LEDs. It will be appreciated that any arrangement of straight and/or curved portions and of solid and/or aperture bearing portions may be utilized to fit the design needs of the particular LED board being used. It should also be recognized that any number of retention members may be used to secure an LED board to a substrate. Moreover, the retention members may be provided at any location along the length of the board, including at the ends of a board.

Figure 8:
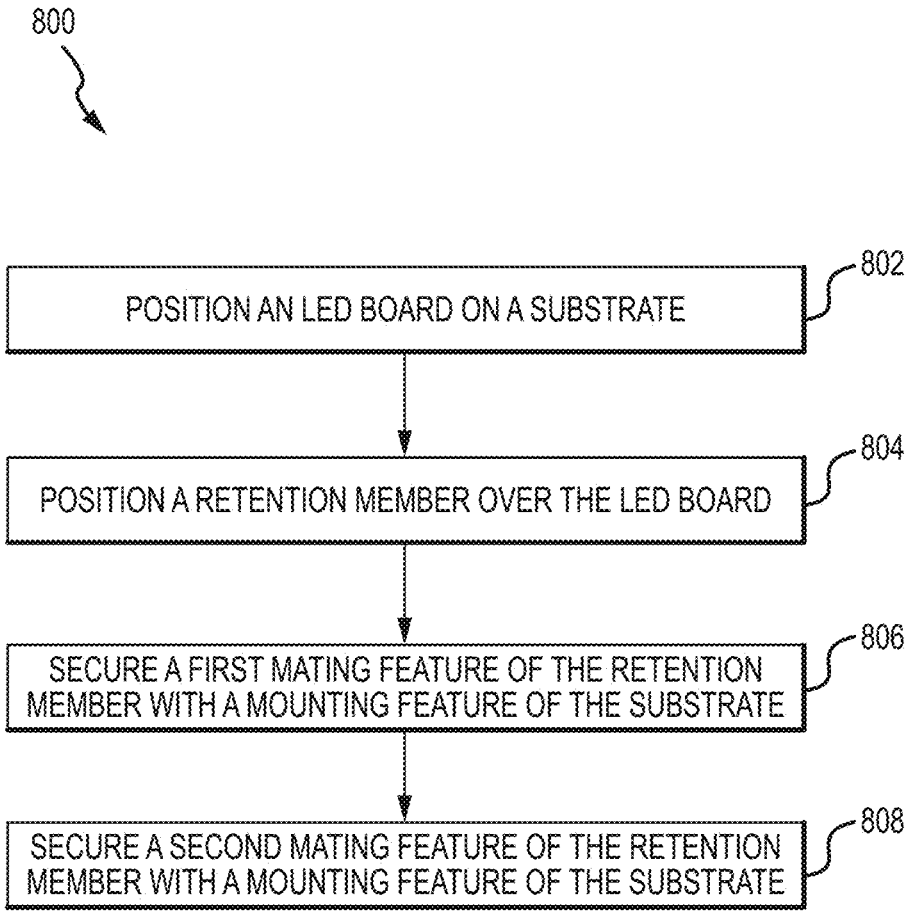
FIG. 8 depicts a flowchart for a method of securing an LED board to a substrate according to embodiments.

FIG. 8 is a flowchart of one embodiment of a process 800 for securing an LED board to a substrate. Process 800 may be performed using any of the retention members, substrates, and/or LED boards described herein. Process 800 may begin at block 802 by positioning an LED board on a substrate such that a plurality of mounting features of the substrate remained exposed beyond an outer periphery of the LED board. At block 804, a retention member may be positioned over the LED board so as to extend between adjacent LEDs on the board and such that a portion of the LED board is positioned between a body of the retention member and the substrate. First and second retention wings of the retention member may extend beyond a width of the LED board. A first retention feature extends from the first retention wing and a second retention feature extends from the second retention wing beyond the outer periphery of the LED board.

In embodiments where LEDs on the LED board are arranged in symmetric rows, a retention member such as retention member 100 may be used. With retention member 100, the retention member body 102 extends adjacent LEDs within a single row and/or multiple, aligned rows of the LED board.

In embodiments where LEDs on the LED board are arranged in staggered and/or offset rows, a retention member such as retention member 400 may be used. With retention member 400, the first portion 416 of the retention member body 402 having aperture 412 may be positioned around one or more LEDs within a first row of the LED board, while the second portion 418 of the retention member body 402 may be positioned within a blank space between adjacent LEDs of a second row of the LED board staggered relative to the first row.

Retention members 600 and 700 may be used on LED boards where some of the LEDs are arranged in rows that are aligned or symmetrical while other of the LEDs are arranged in rows that are staggered relative to other of the rows. With retention member 600, the retention member body 604 near the first and second retention wings 606 and 608 may be positioned within blank spaces formed between adjacent LEDs of the two outer rows of the LED board which are symmetric relative to each other. The aperture 602 may be positioned around one or more LEDs in a center row of the LED board, which is staggered relative to the outer rows. With retention member 700, each aperture 704 may be positioned around one or more LEDs within the outer rows of LEDs of the LED board which are symmetric relative to each other. The medial portion 710 may extend across the LED board between the blank space formed between adjacent LEDs in the central row, which is staggered relative to the outer rows.

Process 800 may also include securing the first retention feature with one of the plurality of mounting features of the substrate at block 806. This may include inserting a protrusion and/or flange on the first retention wing into an aperture or slit defined by the substrate. In other embodiments, the securing may involve inserting a flange and/or protrusion of the substrate into an aperture or slit defined by the first retention wing. It will be appreciated that other fastening mechanisms may be contemplated in accordance with the invention. At block 808, the second retention feature may be secured with another one of the plurality of mounting features of the substrate. In some embodiments, this may involve a similar coupling as between the first retention feature and the substrate mounting feature; however, in other embodiments the retention features of the first and second retention wings may be distinct from one another. Oftentimes, the retention features will be the same to aide in the ease of manufacture of both the retention members and substrates.

It should be noted that the systems and devices discussed above are intended merely to be examples. It must be stressed that various embodiments may omit, substitute, or add various procedures or components as appropriate. Also, features described with respect to certain embodiments may be combined in various other embodiments. Different aspects and elements of the embodiments may be combined in a similar manner. Also, it should be emphasized that technology evolves and, thus, many of the elements are examples and should not be interpreted to limit the scope of the invention.

Specific details are given in the description to provide a thorough understanding of the embodiments. However, it will be understood by one of ordinary skill in the art that the embodiments may be practiced without these specific details. For example, well-known structures and techniques have been shown without unnecessary detail in order to avoid obscuring the embodiments. This description provides example embodiments only, and is not intended to limit the scope, applicability, or configuration of the invention. Rather, the preceding description of the embodiments will provide those skilled in the art with an enabling description for implementing embodiments of the invention. Various changes may be made in the function and arrangement of elements without departing from the spirit and scope of the invention.

Having described several embodiments, it will be recognized by those of skill in the art that various modifications, alternative constructions, and equivalents may be used without departing from the spirit of the invention. For example, the above elements may merely be a component of a larger system, wherein other rules may take precedence over or otherwise modify the application of the invention. Also, a number of steps may be undertaken before, during, or after the above elements are considered. Accordingly, the above description should not be taken as limiting the scope of the invention.

What is claimed is:

1. A retention member for securing a light emitting diode (LED) board to a substrate, wherein the LED board comprises a width and at least one row of LEDs, and wherein the retention member comprises a width greater than the width of the LED board and:

a. a retention member body configured to extend across the width of the LED board between LEDs within the at least one row of LEDs, wherein the retention member body comprises a recess formed on an underside of the retention member body configured to receive the LED board;

b. a first retention wing integral with the retention member body and comprising a first protrusion configured to engage a first aperture defined by the substrate; and c. a second retention wing integral with the retention member body and comprising a second protrusion configured to engage a second aperture defined by the substrates wherein:

at least a portion of a bottom surface of each of the first retention wing and the second retention wing is positioned against a top surface of the substrate;

each of the first protrusion and the second protrusion is configured to extend through a respective one of the first aperture and the second aperture such that each protrusion contacts a bottom surface of the substrate.

2. The retention member of claim 1, wherein:

the retention member body defines at least one aperture configured to receive at least one LED within the at least one row of LEDs.

3. The retention member of claim 1, wherein:

the retention member is configured to snap fit onto the substrate so as to trap the LED board between the retention member and the substrate.

4. The retention member of claim 1, wherein:

the retention member body extends in a plane; and the first retention wing and the second retention wing each extends in a plane offset from the plane of the retention member body.

5. The retention member of claim 1, wherein:

the recess comprises a height that is substantially the same as a height of the LED board.

6. The retention member of claim 5, wherein:

the recess comprises a width that is substantially the same as a width of the LED board.

7. The retention member of claim 1, wherein:

the retention member comprises an electrically non-conductive material.

8. The retention member of claim 1, wherein:

the retention member body has a thickness that is less than or equal to a height of at least one LED within the at least one row of LEDs.

9. The system of claim 8, wherein:

the at least one row of LEDs comprises a first row of LEDs and a second row of LEDs;

LEDs within the first row of LEDs are staggered relative to LEDs within the second row of LEDs; and the retention member body defines an aperture, wherein at least one LED of the first row of LEDS is positioned within the aperture and wherein the retention member body extends between adjacent LEDs within the second row of LEDs.

10. The system of claim 8, wherein:

the at least one row of LEDs comprises a first row of LEDs and a second row of LEDs;

LEDs within the first row of LEDs are in a symmetric and parallel arrangement relative to LEDs within the second row of LEDs;

the retention member body defines a first aperture configured to receive an LED of the first row of LEDS; and the retention member body defines a second aperture configured to receive an LED of the second row of LEDS.

11. The system of claim 10, wherein:

the at least one row of LEDs further comprises a third row of LEDs interposed between, and staggered relative to, the first and second rows of LEDs; and the retention member body extends between adjacent LEDs within the third row of LEDs.

12. The system of claim 8, wherein:

the recess comprises a height that is substantially the same as a height of the LED board.

13. The system of claim 12, wherein:

the recess comprises a width that is substantially the same as a width of the LED board.

14. The system for securing a light emitting diode (LED) board to a substrate of claim 8, wherein:

the retention member comprises an electrically non-conductive material.

15. A system for securing a light emitting diode (LED) board to a substrate, the system comprising:

a substrate defining a plurality of apertures;

an LED board positioned on the substrate and comprising a plurality of LEDs provided in at least one LED row along a length of the LED board; and at least one retention member comprising:

a retention member body extending across the width of the LED board and between LEDs within the at least one row of LEDs, the retention member body comprising a recess formed on an underside of the retention member body, wherein the LED board is positioned at least partially within the recess;

a first retention wing integral with the retention member body and comprising a first protrusion engaged with one of the plurality of apertures on the substrate such that the first protrusion contacts a bottom surface of the substrate; and a second retention wing integral with the retention member body and comprising a second protrusion engaged with another of the plurality of apertures on the substrate such that the second protrusion contacts the bottom surface of the substrate, wherein at least a portion of a bottom surface of each of the first retention wing and the second retention wing is positioned against a top surface of the substrate.

16. A method a securing an LED board to a substrate, wherein the LED board comprises at least one row of LEDs and the substrate comprises a plurality of apertures, the method comprising:

positioning the LED board on the substrate;

positioning a retention member across the LED board such that the LED board is positioned between a body of the retention member and the substrate and such that the body of the retention member extends between LEDs within the at least one row of LEDs, the retention member further comprising a first retention wing integral with the body and a second retention wing integral with the body, wherein at least a portion of a bottom surface of each of the first retention wing and the second retention wing is positioned against a top surface of the substrate;

securing a first protrusion provided on the first retention wing with one of the plurality of apertures on the substrate such that the first protrusion extends through the one of the plurality of apertures and contacts a bottom surface of the substrate; and securing a second protrusion provided on the second retention wing with another one of the plurality of apertures on the substrate such that the second protrusion extends through the another of the plurality of apertures and contacts the bottom surface of the substrate.

17. The method of claim 16, wherein:

the at least one row of LEDs comprises a first row of LEDs and a second row of LEDs;

LEDs within the first row of LEDs are staggered relative to LEDs within the second row of LEDs;

the body of the retention member defines an aperture; and positioning the retention member across the LED board further comprises positioning the body of the retention member on the LED board such that at least one LED within the first row of LEDs is positioned within the aperture.

* * * * *